US011179762B2

(12) United States Patent
Marx et al.

(10) Patent No.: US 11,179,762 B2
(45) Date of Patent: Nov. 23, 2021

(54) METHOD AND DEVICE FOR PRODUCING SHEET-METAL COMPONENTS

(71) Applicants: ThyssenKrupp Steel Europe AG, Duisburg (DE); thyssenkrupp AG, Essen (DE)

(72) Inventors: Arndt Marx, Mettlach-Orscholz (DE); Daniel Caspary, Abentheuer (DE); Olaf Müller, Nohfelden (DE); Martin Kibben, Dinslaken (DE); Daniel Nierhoff, Mülheim a. d. Ruhr (DE); Thomas Flehmig, Ratingen (DE)

(73) Assignee: thyssenkrupp AG, Essen (DE)

( * ) Notice: Subject to any disclaimer, the term of this patent is extended or adjusted under 35 U.S.C. 154(b) by 156 days.

(21) Appl. No.: 16/470,768

(22) PCT Filed: Dec. 21, 2017

(86) PCT No.: PCT/EP2017/084087
§ 371 (c)(1),
(2) Date: Jun. 18, 2019

(87) PCT Pub. No.: WO2018/115282
PCT Pub. Date: Jun. 28, 2018

(65) Prior Publication Data

US 2020/0078849 A1 Mar. 12, 2020

(30) Foreign Application Priority Data

Dec. 23, 2016 (DE) ..... 10 2016 125 671.4

(51) Int. Cl.
*B21D 35/00* (2006.01)

(52) U.S. Cl.
CPC ..... *B21D 35/002* (2013.01)

(58) Field of Classification Search
CPC ..... B21D 35/002; B21D 24/16; B21D 22/02; B21D 22/06; B21D 22/20; B21D 22/22; B21D 22/24; B21D 22/30
(Continued)

(56) References Cited

U.S. PATENT DOCUMENTS 2,664,062 A 12/1953 Bentsen
8,522,593 B2 9/2013 Flehmig et al.
(Continued)

FOREIGN PATENT DOCUMENTS

CN 101612637 A 12/2009
CN 101758148 A 6/2010
(Continued)

OTHER PUBLICATIONS

Chinese Search Report for CN Application No. 2017800801868 dated May 11, 2020.
(Continued)

*Primary Examiner* — Adam J Eiseman
*Assistant Examiner* — Matthew Stephens
(74) *Attorney, Agent, or Firm* — RMCK Law group PLC

(57) ABSTRACT

A method for producing dimensionally highly accurate sheet-metal components is provided. A blank is formed to a preformed part, wherein the preformed part in the cross section at least in regions has an excess developed length. The preformed part is calibrated in regions to a calibrated part while at least in regions using the excess developed length of the cross section of the preformed part, wherein the preformed edges of the preformed part during the calibrating are at least in regions disposed so as to be free of any form-fit. The calibrated part is trimmed at least in regions after the calibrating, in order for the sheet-metal component
(Continued)

(60) to be produced. A device for producing dimensionally highly accurate sheet-metal components is moreover described.

14 Claims, 6 Drawing Sheets

(58) Field of Classification Search
USPC ..... 72/338, 702
See application file for complete search history.

(56) References Cited

U.S. PATENT DOCUMENTS

| | | | | |
|---|---|---|---|---|
| 2009/0305075 | A1* | 12/2009 | Flehmig | B23K 26/262 428/603 |
| 2010/0133724 | A1* | 6/2010 | Flehmig | B21D 22/21 264/294 |
| 2011/0100085 | A1* | 5/2011 | Kubo | B21D 24/04 72/350 |
| 2012/0282482 | A1* | 11/2012 | Flehmig | B21D 37/08 428/603 |
| 2014/0242346 | A1* | 8/2014 | Nielsen | B21D 22/203 428/174 |
| 2016/0052037 | A1 | 2/2016 | Flehmig et al. | |
| 2016/0067757 | A1 | 3/2016 | Flehmig et al. | |
| 2016/0354825 | A1* | 12/2016 | Shinmiya | B21D 22/02 72/350 |
| 2017/0225216 | A1 | 8/2017 | Flehmig et al. | |
| 2017/0297076 | A1* | 10/2017 | Watanabe | G06F 30/00 72/350 |

FOREIGN PATENT DOCUMENTS

| | | | |
|---|---|---|---|
| CN | 101888908 | A | 11/2010 |
| DE | 102007059251 | A1 | 6/2009 |
| DE | 102008037612 | A1 | 6/2010 |
| DE | 102009059197 | A1 | 6/2011 |
| DE | 102008037612 | | 1/2014 |
| DE | 102013103612 | A1 | 10/2014 |
| DE | 102013103751 | A1 | 10/2014 |
| EP | 2217393 | B1 | 3/2012 |
| GB | 189713351 | A | 5/1898 |
| JP | S5731417 | A | 2/1982 |

OTHER PUBLICATIONS

German Office Action for DE Application No. 102016125671.4 dated Oct. 13, 2017.

International Search Report and Written Opinion for International Application No. PCT/EP2017/084087 dated Mar. 16, 2018 with English translation.

* cited by examiner

METHOD AND DEVICE FOR PRODUCING SHEET-METAL COMPONENTS

CROSS-REFERENCE TO RELATED APPLICATIONS

This application is a 371 U.S. National Stage of International Application No. PCT/EP2017/084087, filed Dec. 21, 2017, which claims priority to German Application No. 10 2016 125 671.4 filed on Dec. 23, 2016. The disclosure of each of the above applications is incorporated herein by reference in their entirety.

FIELD

The invention relates to a method for producing sheet-metal components and to a device for producing sheet-metal components, in particular for carrying out a method according to the invention.

BACKGROUND

Deep-drawing as a proven forming method is usually used for producing sheet-metal components having a complex geometry. The mostly flat sheet metal herein is jammed between the blank holder or sheet-metal holder, respectively, and the draw ring or die, respectively, and is then drawn into the die by way of a ram. It is also commonplace for the sheet-metal component to be produced in a plurality of shape-imparting operations, in this instance using a plurality of tools.

In these conventional deep-drawing methods the tendency of the sheet-metal component to spring back as a result of the inhomogeneous stress state after the drawing, and the sensitivity in terms of variations between batches, are in particular disadvantageous. The spring-back to be expected is already taken into account in the design of the forming tools in the manner that the spring-back to be expected is incorporated in the opposite direction into the tool by way of classic compensation measures, so as to thus obtain an ideally dimensionally accurate component after the inhomogeneous stress state has been relaxed.

Such compensation measures on the tools can however typically only be designed with a view to a specific spring-back state. Said compensation measures are moreover comparatively time-consuming in terms of the implementation, are complicated, and in most instances have to be adapted to the desired result by way of a plurality of iterations or corrective tool grinding operations, respectively.

It is however problematic herein that the dimensional accuracy of the sheet-metal components can no longer be maintained after a change in the material batch (in particular after a change in the coil from which the metal sheets or blanks are produced), because the spring-back in this instance often varies deviatingly.

The spring-back and the insufficient process stability thus form the greatest obstacles to the use of high-strength steel or aluminum materials for the production of dimensionally accurate sheet-metal components such as, for example, pressed body parts, and represent great challenges to the forming industry.

From the prior art it is known to effectively counteract the undesirable spring-back by impinging the sheet-metal components by compressive stress which results in plasticization.

For example, the German first and unexamined publication DE 10 2007 059 251 A1, the German first and unexamined publication DE 10 2008 037 612 A1, the German first and unexamined publication DE 10 2009 059 197 A1, the German first and unexamined publication DE 10 2013 103 612 A1, and the German first and unexamined publication DE 10 2013 103 751 A1 thus describe methods in which a material excess is utilized for producing a dimensionally accurate component.

SUMMARY

A preformed part which while being as close as possible to the final shape of the component but with the difference that a defined material excess is incorporated in specific component portions is typically generated in one method step or optionally in a plurality of method steps. Compressive stresses are generated in a targeted manner in the material by special compressing of the entire component in a subsequent method step. The component edge herein at least in regions is supported in a form-fitting manner on the calibrating tool, wherein the material excess which is in particular provided in the form of a comparatively large developed length is preferably displaced only in the direction of the sheet-metal thickness in the compressing process. This method does indeed eliminate the disadvantages mentioned above and provides a minimum investment in material, but in itself has separate undesirable collateral effects.

It has thus been demonstrated that measures by way of which a precisely repeated position of the component peripheries of the preformed part and thus of the preformed edge that is relevant to the subsequent calibrating is guaranteed are required in particular for the production of the preformed part. By ensuring a precisely repeated spatial position of the preformed edge of the preformed part produced, it is achieved in principle that the envisaged material excess for the subsequent calibrating step is ideally present in each cross section of the preformed part. For example, the developed lengths of the local cross sections thus viewed herein are approximately 1.0 to 3.0% larger than required for the final geometry of the sheet-metal component. Should the developed length of the cross sections vary excessively as a result of the process management in the production of the preformed part, not enough material excess for the subsequent calibrating step would be available in the case of an insufficient length, on account of which the dimensional accuracy of the sheet-metal component would be compromised. By contrast, should the developed length of the viewed cross section of the preformed part be excessive, the thus excessively dimensioned material excess would collapse to form undulations during the subsequent calibrating process, which can mean an optical and/or dimensional defect. In addition, the calibrating tool would be thereby stressed in an unreliable manner. In the case of an excessively varying developed length of the local cross sections of the preform, the form-fitting support of the component edges of the preform, described above, on the calibrating tool during the compressing process is therefore not implementable in terms of a reliable process.

The afore-described disadvantages are thus associated with the fact that the calibrating effect is applied also across the preformed edge and said preformed edge for the purpose of setting an optimal calibrating effect must lie in a sufficiently precisely repeated and reproducible manner in the calibrating tool shortly before the actual compressing and/or calibrating process starts.

In order to ensure that the spatial position of the preformed edge and the local distribution of the material excess correspond to the conditions required for calibrating, special measures can be taken in the production of the preformed part. For example, a spaced sheet-metal holder can thus be used, so as to thus keep as low as possible the influence of friction and thus the influence of variations between batches on the developed length of the cross sections. The local developed lengths of the cross sections of the preform and thus the position of the preformed edge of the preform placed in the calibrating tool, can often be produced so as to be precisely repeated by deep-drawing without a sheet-metal holder or a spaced sheet-metal holder.

It has however been demonstrated that an exact position of the preformed edges for specific sheet-metal components, owing to the geometry thereof, cannot be reliably produced by way of the measures taken to date. Depending on the geometry to be produced, it can thus be quite desirable for the material flow in drawing to be at least in regions decelerated by way of a sheet-metal holder in such a manner that an undesirable formation of creases does not arise. Preformed parts produced in such a manner then indeed meet the required geometry, however, the developed length of the cross sections in this instance varies in such a manner that the preformed parts thus produced cannot be processed in the following calibrating tool, or can only be processed to a limited extent in the latter.

Proceeding therefrom it is an object of the present invention to provide a method and a device by way of which the disadvantages described can be reduced or eliminated.

In the case of a generic method for producing sheet-metal components the object is achieved in that the method comprises the steps of:

- forming a blank to a preformed part, wherein the preformed part in the cross section at least in regions has an excess developed length;
- calibrating at least in regions the preformed part to a calibrated part while at least in part using the excess developed length of the cross section of the preformed part, in particular for building up additional compressive stresses, wherein the preformed edges of the preformed part during the calibrating are at least in regions disposed so as to be free of any form-fit; and
- at least in regions the calibrated part after the calibrating, in order for the sheet-metal component to be produced.

By contrast to the prior art, in the case of the method proposed a preformed part which in the cross section at least in regions has an excess developed length is proposed, on the one hand. At the same time, the preformed edges of the preformed part during the calibrating are at least in regions disposed so as to be free of any form-fit. A disposal that at least in regions is free of any form-fit is understood to mean that specific regions of the preformed edge can also be disposed in a form-fitting manner. A disposal that is free of any form-fit is in particular to be understood to mean that an outward movement of the preformed edges, when viewed in the cross section, is not to be prevented in a form-fitting manner. In other words, the preformed edges at least in regions are not prevented in a form-fitting manner from yielding. It is thus no longer necessary for the preformed edges to be exactly positioned in the calibrating tool, since said preformed edges are not brought to bear in a form-fitting manner in the tool. The influencing of the material flow, for example by way of jamming the blank between the force-impinged sheet-metal holder and the die, is thus enabled for the production of the preform. Typical negative effects of irregularities in terms of the developed length of the preformed part in the cross section, such as the formation of undulations or fissures, can be reduced or avoided. Forming methods which, because of the required exact position of the preformed edges in the following calibrating, to date have not been able to be used can consequently be used when forming the preformed part. For example, drawing can thus be operated using sheet-metal holders, draw beads, or a plurality of drawing stages. The irregular developed length of the preformed part in the cross section, created thereby, by virtue of the otherwise usual form-fit, as a function of the batch and the tribology, at the preformed edges in the calibrating tool is unproblematic said form-fit now being absent at least in regions. Finally, the sheet-metal component (in particular the desired length of the sheet-metal component in the cross section) can be achieved so as to have a final geometry (finished dimension) by edge-trimming of the calibrated part carried out after the calibrating. The trimming tool herein can advantageously be embodied so as to be close to the nominal geometry and does not have to be adapted to the preformed part having been sprung-back, as is current practice.

The sheet-metal component preferably has a base region, a wall region and/or an optional flange region. The calibrated part accordingly preferably already has a base region, a wall region and/or an optional flange region. The preformed part preferably also already has a base region, a wall region and/or an optional flange region. The preformed part already has a geometry that is close to the final geometry, for example, but is exposed to an undesirable spring-back. To this extent, the preformed part can be considered to be a sprung-back formed part.

The preformed part in the cross section at least in regions having an excess developed length is in particular understood to mean that the developed or stretched length of the preformed part in the cross section at least in regions is larger than required by the final geometry of the sheet-metal component. The preformed part in local cross sections at least in regions preferably has a developed length which is larger than required for the following calibrating. For example, the developed length of the preformed part in the cross section at least in regions is more than 3%, preferably more than 5%, larger than required for the final geometry of the sheet-metal component.

The forming, for example the drawing or preferably the deep-drawing, is carried out in a drawing tool, for example. Deep-drawing using draw beads, draw shoulders and/or a multi-stage deep-drawing can advantageously be used in the proposed method, since a precisely repeated length of the developed length of the local cross sections is not important in calibrating. The forming can in particular comprise ironing.

The calibrating is carried out in a calibrating tool, for example. The calibrating of the preformed part to the calibrated part preferably comprises at least in regions compressing of the preformed part.

The trimming of the calibrated part is carried out in a trimming tool, for example. Trimming of the calibrated part is carried out (in particular using cutting blades or by means of laser beam cutting), for example. Required protrusions and/or perforations are likewise incorporated in the calibrated part in the context of trimming, for example.

In one example, the trimming of the calibrated part after the calibrating is performed in a separate tool. However, it is likewise possible for the trimming to be performed in the calibrating tool, for example after reaching the terminal position of the calibrating ram.

In principle, the forming, calibrating and/or trimming can be carried out in separate devices. However, it is also possible for the forming, calibrating and/or trimming at least in part to be carried out in a combined device.

The blank and thus the preformed part, the calibrated part, and the sheet-metal component having the final geometry are preferably produced from an aluminum material or steel material. For example, a high-strength steel, for example a multiphase steel, is used.

According to one preferred embodiment of the method according to the invention, the calibrated part has a flange region, and the trimming of the calibrated part comprises a partial removal of the flange region. The preformed part particular preferably also already has a flange region. The at least in regions one excess developed length of the preformed part in the cross section in this instance is in particular achieved by the flange region. The flange region is preferably at least in part calibrated, in particular compressed, by the calibrating of the preformed part. Part of the flange region, or the complete flange region, of the calibrated part is then removed by the trimming. The non-calibrated part of the flange region can be removed by the trimming, for example. An at least in part calibrated region of the flange region can likewise be removed by the trimming, for example.

According to one preferred embodiment of the method according to the invention an undesirable material flow in the direction of the preformed edges of the preformed part during the calibrating is at least in regions reduced or suppressed, in particular by means of a decelerating effect, in particular by friction, force-fit and/or form-fit, on the sheet-metal upper side and/or the sheet-metal lower side. This prevents excess material from flowing outward and then not being able to contribute toward the calibrating. In the case of a disposal of the preformed edges of the preformed part during the calibrating that is at least in regions free of any form-fit this can be established in particular in that a decelerating effect is exerted on the sheet-metal upper side and/or the sheet-metal lower side of the preformed part during the calibrating. The undesirable outward material flow is preferably counteracted exclusively in this way. The preformed part, in particular the flange region of the preformed part, is jammed in the calibrating tool, for example.

According to one preferred embodiment of the method according to the invention the material flow when forming the blank to the preformed part is at least in regions decelerated, in particular by way of a form-fit and/or force-fit. In that the material flow when forming, in particular deep-drawing, is at least in regions decelerated, for example using a sheet-metal holder, an undesirable formation of creases can be reduced or avoided, for example, and the preforms can particularly be produced so as to be advantageously, in particular largely, free of undulations, even in the case of complex geometries. On account thereof, the length of the developed length of the local cross sections of the preformed part is indeed modified under circumstances, depending on the batch. This, however, is not problematic by virtue of the disposal of the preformed edges, which at least in regions is free of any form-fit, during the calibrating.

In order to achieve a controlled material flow and thus an advantageous geometry of the sheet-metal component without fissures and creases, according to one preferred embodiment of the method according to the invention, one or a plurality of draw beads, one or a plurality of draw shoulders and/or multi-stage forming are used when forming, in particular deep-drawing, the blank to the preformed part. The previously existing limits in the production of a suitable preformed part can be significantly extended in this way.

According to one preferred embodiment of the method according to the invention the method, from forming the blank until trimming the calibrated part after the calibrating, is carried out without any trimming. Apart from the production of the blank, there is thus in particular no intervening trimming procedure prior to the calibrating.

According to one preferred embodiment of the method according to the invention regions that are at least in regions calibrated are removed by the trimming of the calibrated part after the calibrating. An at least in regions calibrated optional flange region is preferably removed by the trimming after the calibrating. The desired final geometry of the component can be achieved by way of a reliable process on account thereof, even when an additional developed length of the preformed part in the cross section is generated during the forming, in particular the deep-drawing procedure. It can moreover be ensured that the final sheet-metal component is calibrated in a substantially fully planar manner.

According to one preferred embodiment of the method according to the invention the forming of the blank to the preformed part already comprises compensation measures aimed at producing a geometry of the preformed part that is particularly close to the final geometry. For example, forming (for example over-bending of the wall region) of the preformed part is carried out counter to the expected spring-back when deep-drawing, for example by way of a corresponding design of the deep-drawing tool. By virtue of the disposal of the preformed edges that at least in regions is free of any form-fit, variations in the spring-back of the preformed part, or variations by virtue of the batch change, the wear of the preforming tool, or the tribological properties, can be equalized by the calibrating.

According to one preferred embodiment of the method according to the invention the preformed part has a material excess in a base region of the preformed part, in a wall region of the preformed part, in an optional flange region of the preformed part and/or in one or a plurality of transition regions therebetween. It has been demonstrated that a material excess can be provided in said regions and can be utilized during the calibrating despite a disposal for calibrating that is at least in regions free of any form-fit.

According to preferred embodiments of the method according to the invention the sheet-metal component, when viewed in the cross section, is at least in portions configured so as to be substantially hat-shaped. The sheet-metal component along the main extent thereof can likewise have cross-sectional variations. Thin spots, undulations and fissures that often arise in the production can be reduced or avoided by the method described in particular in the case of sheet-metal components which, when viewed in the cross section, are hat-shaped, in particular in combination with cross-sectional variations.

In the case of a generic device for producing sheet-metal components the object is achieved by a device having

- forming means for forming a blank to a preformed part in such a manner that the preformed part in the cross section at least in regions has an excess developed length;
- calibrating means for at least in regions calibrating the preformed part to a calibrated part while at least in part using the excess developed length of the cross section of the preformed part, in particular for building up additional compressive stresses in such a manner that the preformed edges of the preformed part during the calibrating are at least in regions disposed so as to be free of any form-fit; and
- trimming means for at least in regions trimming the calibrated part after the calibrating, in order for the sheet-metal component to be produced.

The device herein can comprise one or a plurality of tools for carrying out the different steps. The device can to this extent in particular comprise a tool system having a plurality of tools. As has already been explained in the context of the method described, in the case of a device according to the invention, by contrast to the prior art, inter alia at least in regions no form-fitting fixing of the edges of the preform is provided when calibrating. The preformed part in the cross section at least in regions having an excess developed length therefore does not have a negative effect on the calibrating. Material that is not required, for example part of an optional flange region, can be removed by the trimming means.

According to preferred embodiments of the device according to the invention, the forming means comprise a preforming tool having a preforming ram, a preforming die, and optionally a sheet-metal holder, and preferably one or a plurality of draw beads and/or one or a plurality of draw shoulders. The forming means can likewise be specified for multi-stage forming. As has already been explained, the developed lengths of the local cross sections of the preform do not have to be achieved in a precisely repeated manner when forming. Auxiliary means such as draw beads can in particular be used on account thereof.

According to preferred embodiments of the device according to the invention, the calibrating means comprise one or a plurality of calibrating tools having one or a plurality of calibrating rams and one or a plurality of calibrating dies. A sufficiently exact positioning of the preformed part herein can already be achieved by the radius of the ram or the die.

According to preferred embodiments of the device according to the invention, the trimming means comprise one or a plurality of trimming tools for at least in regions trimming the calibrated part after the calibrating. For example, the trimming tool comprises one or a plurality of cutting blades. Alternatively or additionally, the trimming tool can be specified for carrying out laser beam cutting. The trimming tool can likewise be specified for carrying out any required protrusions and/or perforations.

In terms of further advantageous design embodiments of the device reference is made to the description of the method and the advantages of the latter.

By way of the description above and hereunder of method steps according to preferred embodiments of the method, corresponding means for carrying out the method steps by preferred embodiments of the device are also to be disclosed. The disclosure of means for carrying out a method step is likewise to disclose the respective method step.

BRIEF DESCRIPTION OF THE DRAWINGS

The invention is to be explained in more detail hereunder by means of exemplary embodiments in conjunction with the drawing in which.

DETAILED DESCRIPTION

Figure 1:
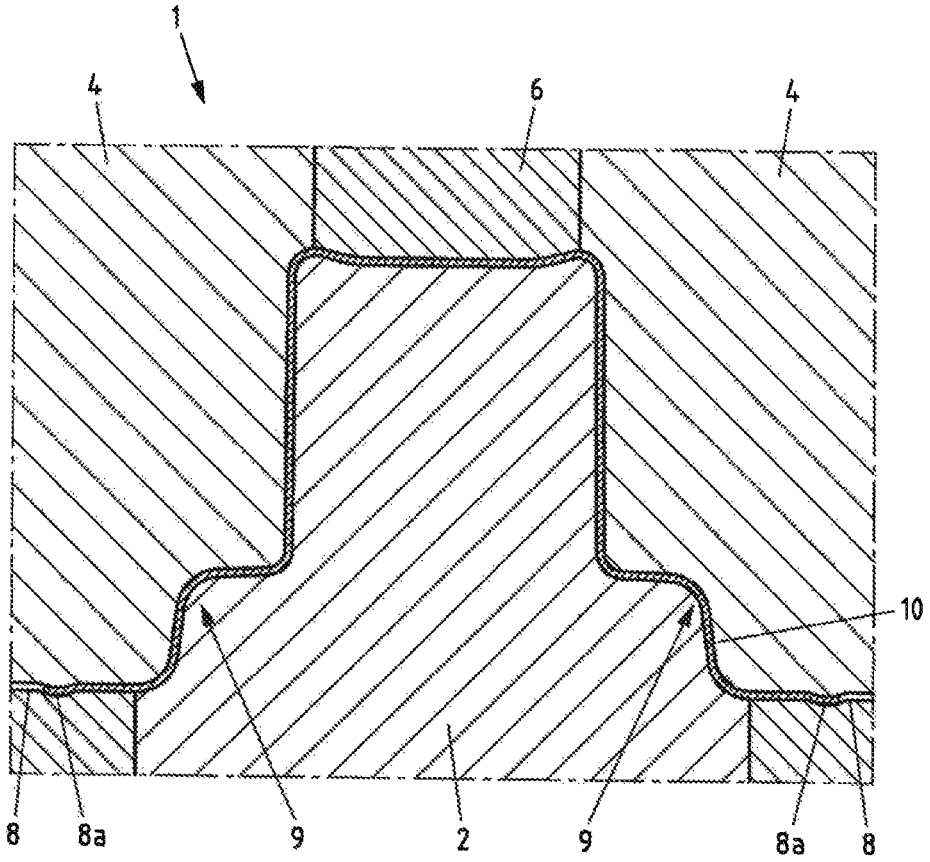
FIG. 1 shows an exemplary embodiment of a preforming tool for carrying out a forming step.

First, FIG. 1 shows an exemplary embodiment of a preforming tool 1 in order for a forming step according to one exemplary embodiment of a method according to the invention to be carried out. The preforming tool 1 comprises a preforming ram 2 and a preforming die 4. Moreover, an optional blank holder 6 which can be disposed, for example, on the slide cushion or springs is illustrated. The preforming tool 1 moreover has sheet-metal holders 8 having draw beads 8*a*. Moreover, draw shoulders 9 are provided. The blank in FIG. 1 has already been formed to the preformed part 10 by deep-drawing.

The blank herein has been formed in such a manner that the geometry of the preformed part 10, having a material reserve included in the base region and/or in the wall region and/or in the flange region and/or in a transition regions between the base region and the wall region and/or the wall region and the flange region, corresponds to the geometry at least required for the subsequent calibrating step.

The preformed part 10 thus established is distinguished in that the developed length of the preformed part 10 in the cross section at least in regions is larger than required for the subsequent calibrating. Commonplace auxiliary means such as the draw beads 8*a* or the draw shoulders 9 are thus also possible in the production of the preformed part 10. In the case of particularly critical components, it is also conceivable for the preformed part 10 to be implemented in a plurality of forming stages. The previously existing limits in the production of a suitable preformed part 10 are significantly extended in this way. It is also conceivable for the preformed part to be produced in a plurality of forming stages of different combinations of drawing, bending, embossing, edge-bending, etc.

Figure 2:
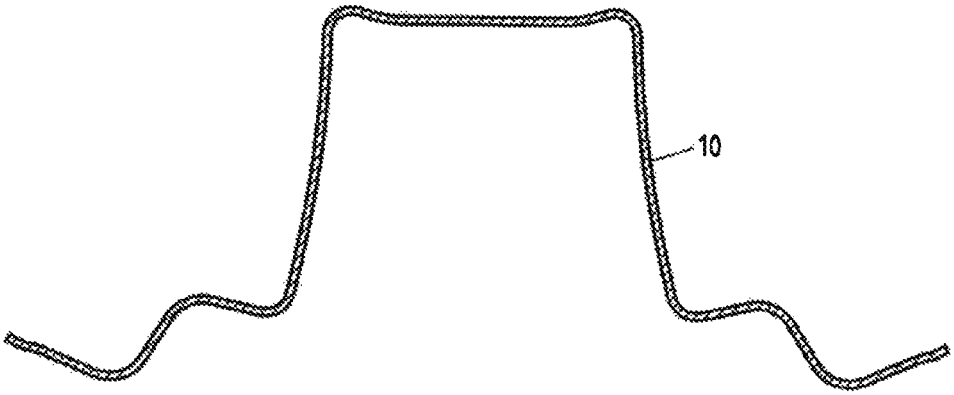
FIG. 2 shows an exemplary embodiment of a preformed part springing back after the preforming.
Figure 3A:
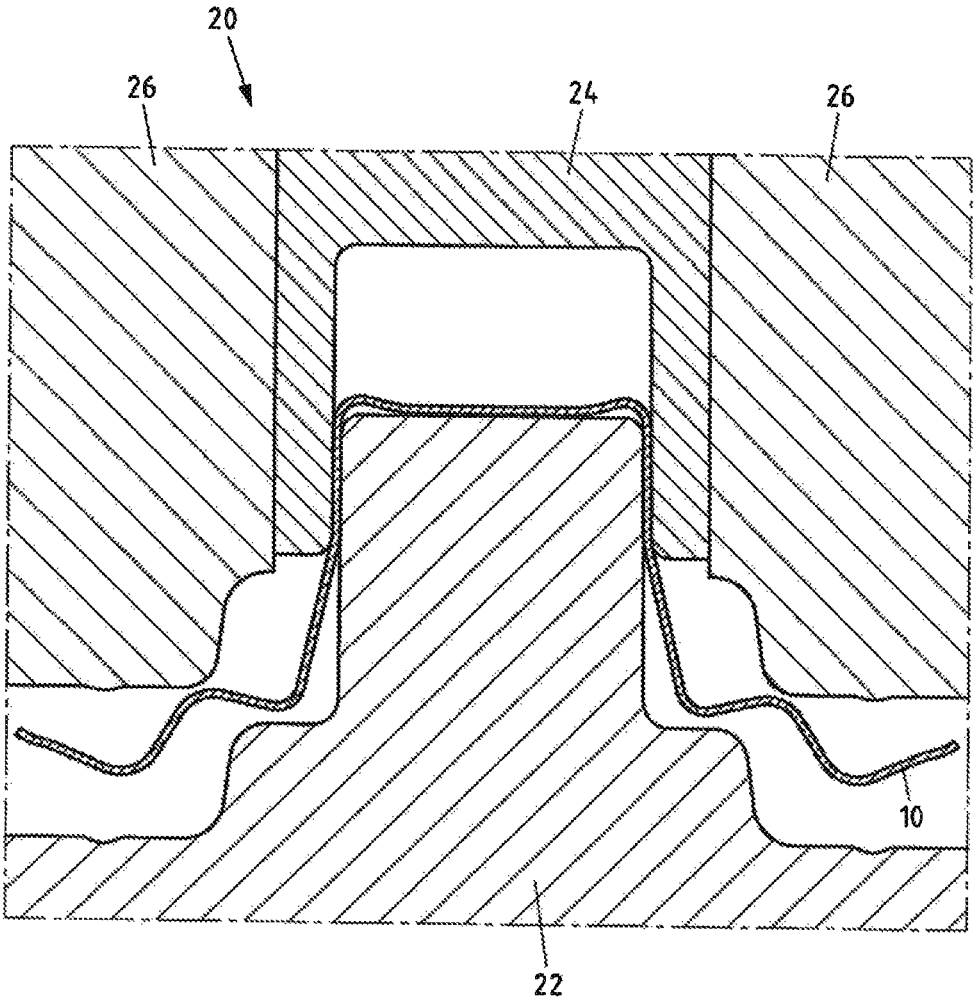
FIGS. 3*a,b* show an exemplary embodiment of a calibrating tool for carrying out a calibrating step.
Figure 3B:
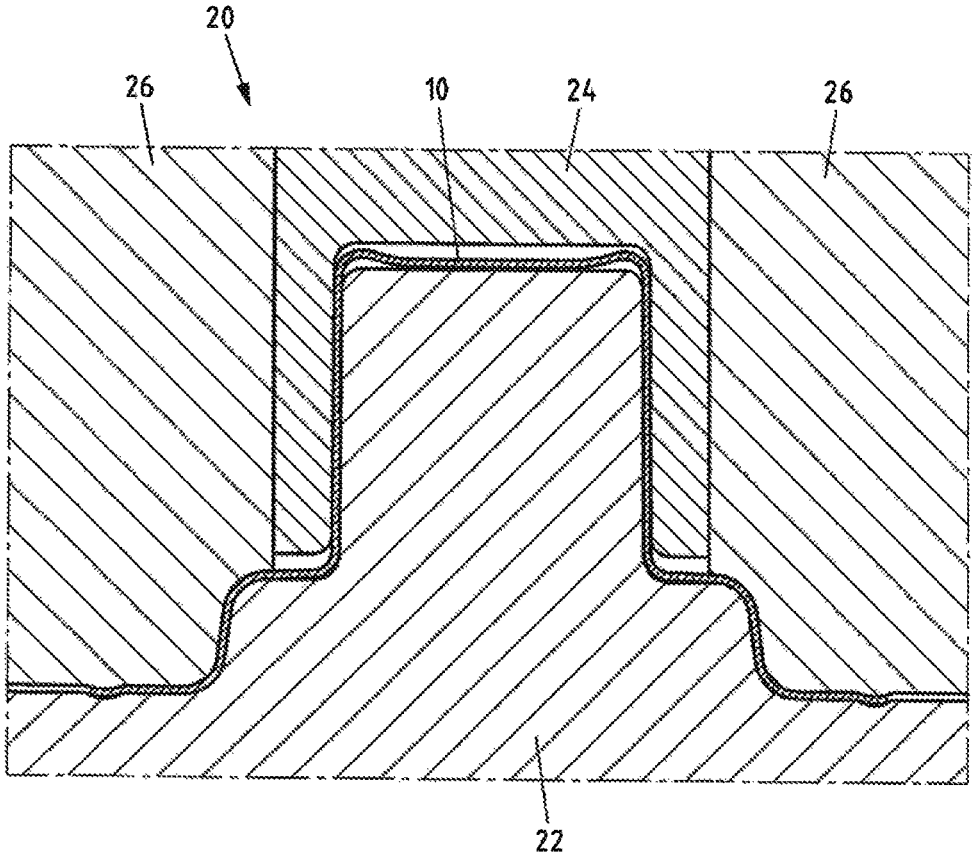

The preformed part 10, as a result of the inhomogeneous stress state, will spring back when retrieved from the preforming tool 1, as is illustrated in FIG. 2. The retrieved preformed part 10 (formed part) is then received in a calibrating tool 20 which reproduces the desired final geometry plus the material addition in the region of the preformed edge, as is illustrated in FIGS. 3*a*, 3*b*. The calibrating tool 20 comprises a calibrating ram 22, a calibrating die 24, and blank holders, or sheet-metal holders 26, respectively, suspended from above.

Figure 4A:
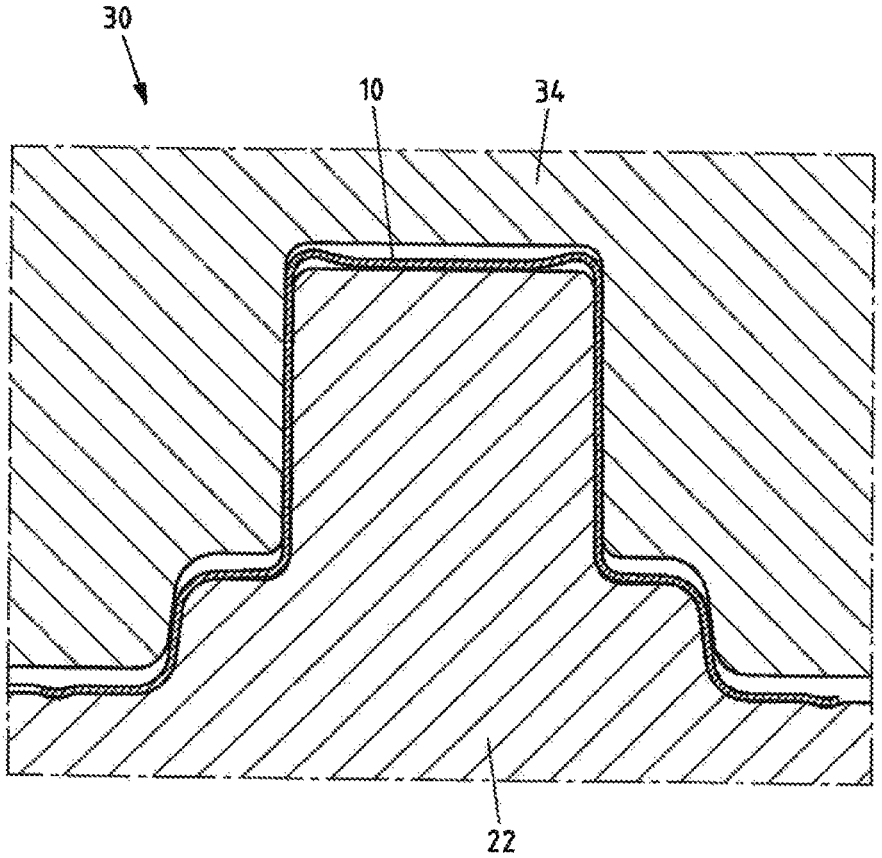
FIGS. 4*a,b* show further exemplary embodiments of calibrating tools for carrying out a calibrating step.
Figure 4B:
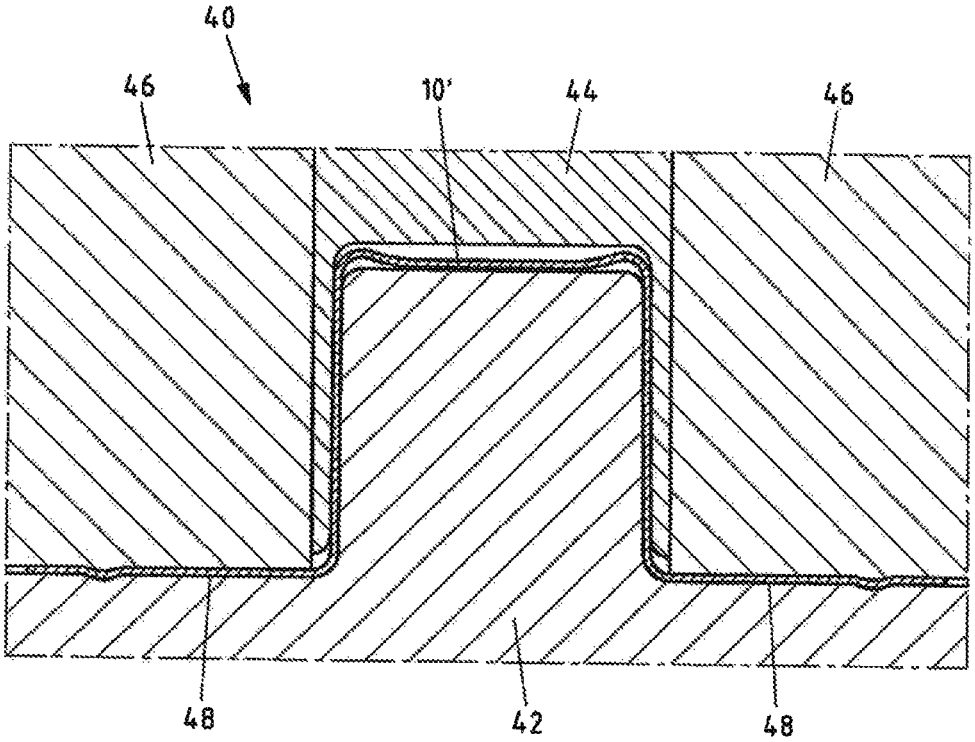

Alternative exemplary embodiments of calibrating tools 30, 40 for carrying out the calibrating step are illustrated in FIGS. 4*a, b*. The calibrating tool 30 is embodied as a two-part tool having a calibrating ram 32 and a calibrating die 34. A blank holder can be dispensed with in this case. The calibrating tool 40 comprises a calibrating ram 42, a calibrating die 44, blank holders 46 suspended above. The flange region of the preformed part 10' in this case formed without a shoulder.

The preformed part 10, 10' (formed part) during the calibrating procedure is fixed in the calibrating tools 20, 30, 40 described such that a flow of the material in the direction of the preformed edge is suppressed during the calibrating. However, the preformed edges of the preformed part 10, 10' are at least in regions disposed so as to be free of any form-fit during the calibrating in said tools 20, 30, 40. The preformed part 10, 10' is thus completely or at least in portions calibrated without the preformed edge being prevented in a form-fitting manner from yielding. An undesirable outward material flow in the direction of the preformed edge herein is achieved only by way of the decelerating effect on the sheet-metal upper side and the sheet-metal lower side, but not by way of a decelerating effect on the preformed edge.

No trimming of the preformed part 10, 10', or of the calibrated part, respectively, has taken place up to this point in time. In the case of the calibrated part being created, this means that the trimming waste to be later removed by means of trimming (for example by means of edge trimming) is first at least in part conjointly calibrated in the calibrating tool 20, 30, 40. A dimensionally accurate calibrated part which is then finally trimmed in order to thus achieve the final sheet-metal component is achieved in this manner.

Compensation measures such as, for example, over-bending of the walls, can already be taken in the design of the preforming tool 1 so as to obtain a preformed part 10, 10' which already corresponds as well as possible to the final geometry. Variations in the spring-back of the preformed part 10, 10' are largely equalized when calibrating, so that no complex correction loops are required here either. The same applies to variations which result from batch change and/or wear of the preforming tools and/or the tribological properties of tools and material.

Figure 5:
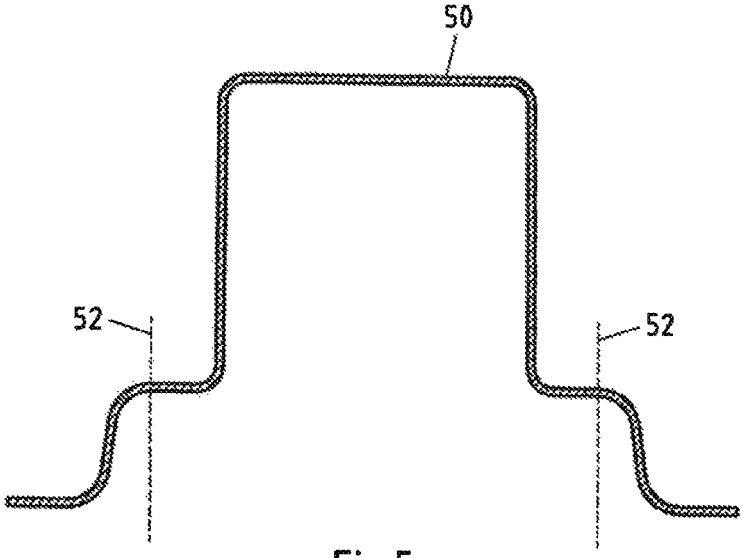
FIG. 5 shows an exemplary embodiment of a calibrated part.

An exemplary embodiment of a calibrated part 50 which has been produced from the preformed part 10 is illustrated in FIG. 5. The region to be severed is indicated in an exemplary manner by the dashed lines 52. The trimming performed after the calibrating can be carried out in one or a plurality of steps and has in particular the advantage that the trimming tools do not have to be adapted to the component sprung-back, as is current practice, but can instead be embodied so as to be close to the nominal geometry. However, in principle it is likewise conceivable for the edge-trimming to be integrated into the calibrating tool 20, 30, 40 when the lower terminal position is reached (not illustrated here).

Figure 6:
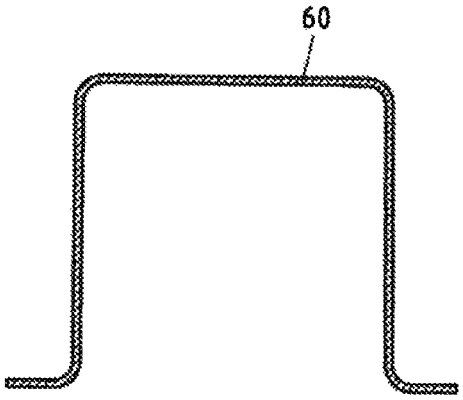
FIG. 6 shows an exemplary embodiment of a sheet-metal component after the trimming.

A sheet-metal component 60 having the final dimension, which has been produced from the calibrated part 50 by edge-trimming, is illustrated in FIG. 6.

Summarizing, the following advantages can in particular be derived from the various exemplary design embodiments of the method described and of the device described.

In terms of the blank to be initially provided, a simplified contour of the cutting blades and less wear can result. Moreover, simplified nesting can result since only one blade contour is usually required.

In terms of the forming of the preformed part 10, 10', complex components which to some extent are capable of being implemented only by way of forming with auxiliary means such as sheet-metal holders 8, draw beads 8*a*, draw shoulders 9 and/or by way of multi-stage forming, can in particular be produced. Moreover, the solidification of modern multiphase steels can be exploited herein. This in turn can to reduced sheet-metal thicknesses and thus to a reduced component weight, in particular in comparison with a process management using embossing and raising, at comparable component performances. Finally, regions at risk of edge fissures can be reduced or avoided.

In terms of the calibrating it can be advantageously achieved, in particular independently of the batch and by way of a reliable process, that the position of the preformed edges in the calibrating tool 20, 30, 40 that is closed until shortly prior to the beginning of the compressing and/or calibrating process does not have any influence on the calibrating effect. This means that the preformed part 10, 10' can be designed in an optimal manner without considering the final sheet-metal component edge for the calibrating step. A classic compensation by means of over-bending or truing can likewise be dispensed with, wherein the classic compensation can in principle also be combined with the method described. It can likewise be advantageous that high surface pressures in the region of the preformed edges that are supported on the tool can no longer be formed by the disposal of the preformed edges in the calibrating tool that is at least in regions free of any form-fit during the compressing and/or calibrating process, and the service life of the calibrating tool can thus be increased.

In terms of the edge-trimming of the calibrated part 50 to the final dimension, known trimming methods that have been tested in volume production can be used and be optionally combined with protrusions and/or perforations required.

The invention claimed is:

1. A method for producing sheet-metal components, the method comprising:

forming a blank to a preformed part wherein the preformed part in a cross section at least in regions has an excess developed length;

calibrating, including a compressing at least in a vertical wall region of the preformed part to a calibrated part while at least in part using the excess developed length of the cross section of the preformed part for building up additional compressive stresses, wherein preformed edges of the preformed part during the calibrating are at least in regions disposed so as to be free of any form-fit; and trimming at least in regions the calibrated part after the calibrating, in order for the sheet-metal component to be produced, wherein the method, from forming the blank until trimming the calibrated part after calibrating, is carried out without any trimming, wherein regions that are at least in regions calibrated are removed by the trimming of the calibrated part after the calibrating.

2. The method as claimed in claim 1, wherein the calibrated part has a flange region, and the trimming of the calibrated part comprises a partial removal of the flange region.

3. The method as claimed in claim 1 wherein an undesirable material flow in a direction of the preformed edges of the preformed part during the calibrating is at least in regions reduced or suppressed by means of a decelerating effect on at least one of the sheet-metal upper side and the sheet-metal lower side.

4. The method as claimed in claim 3, wherein the material flow when forming the blank to the preformed part is at least in regions decelerated.

5. The method as claimed in claim 4, wherein at least one of a draw bead, at least one draw shoulder and multi-stage forming are used when forming the blank to the preformed part.

6. The method as claimed in claim 1, wherein the forming of the blank to the preformed part already comprises compensation measures aimed at producing a geometry of the preformed part that has a resemblance to the final geometry.

7. The method as claimed in claim 6, wherein the excess developed length is in at least one of a base region of the preformed part, in the vertical wall region of the preformed part, in an optional flange region of the preformed part and in at least one transition regions therebetween.

8. The method as claimed in claim 1, wherein the sheet-metal component, when viewed in the cross section, is at least in portions configured so as to be hat-shaped.

9. The method as claimed in claim 1, wherein the sheet-metal component along a main extent thereof has cross-sectional variations.

10. A device for producing sheet-metal components, for carrying out a method as claimed in claim 1, having forming means for forming a blank to a preformed part in such a manner that the preformed part in the cross section at least in regions has an excess developed length;

calibrating means for at least in regions calibrating, including a compressing at least in a vertical wall region of the preformed part to a calibrated part while at least in part using the excess developed length of the cross section of the preformed part for building up additional compressive stresses in such a manner that the preformed edges of the preformed part during the calibrating are at least in regions disposed so as to be free of any form-fit; and trimming means for at least in regions trimming the calibrated part after the calibrating, in order for the sheet-metal component to be produced, wherein the trimming means comprises at least one trimming tool for trimming the calibrated part after the calibrating.

11. The device as claimed in claim 10, wherein the forming means comprise a preforming tool having a preforming ram, and a preforming die.

12. The device as claimed in claim 10, wherein the calibrating means comprise at least one calibrating tool having at least one calibrating ram and at least one calibrating die.

13. The device as claimed in claim 11 wherein the performing tool includes a sheet-metal holder.

14. The device as claimed in claim 13 wherein the performing tool includes at least one draw shoulder.

* * * * *